US008235559B2

(12) United States Patent
Probasco

(10) Patent No.: US 8,235,559 B2
(45) **Date of Patent: *Aug. 7, 2012**

(54) LIGHT FIXTURE

(76) Inventor: Max Alan Probasco, Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/876,058

(22) Filed: Sep. 3, 2010

(65) Prior Publication Data

US 2011/0058371 A1 Mar. 10, 2011

Related U.S. Application Data

(63) Continuation of application No. 11/906,921, filed on Oct. 4, 2007, now Pat. No. 7,810,964.

(51) Int. Cl.
*F21V 21/14* (2006.01)
*F21V 21/30* (2006.01)
*F21V 15/00* (2006.01)

(52) U.S. Cl. ..... 362/372; 362/20; 362/190; 362/235; 362/374; 362/427

(58) Field of Classification Search ..... 362/372, 362/235, 154, 190, 374, 427, 20
See application file for complete search history.

(56) References Cited

U.S. PATENT DOCUMENTS 5,301,094 A * 4/1994 Rodriguez, Jr. ..... 362/254
7,731,398 B2 * 6/2010 Probasco ..... 362/428
7,810,964 B2 * 10/2010 Probasco ..... 362/372

* cited by examiner

*Primary Examiner* — Stephen F Husar
*Assistant Examiner* — James Cranson, Jr.
(74) *Attorney, Agent, or Firm* — Kelly J. Kubasta; Klemchuk Kubasta LLP

(57) ABSTRACT

A light fixture comprises a housing configured to store a plurality of light bulbs therein, wherein at least one of the light bulbs is located in a non-illumination position within the housing. The light fixture may also comprise an openable door such that at least one light bulb is coupled to the door. The light fixture may also comprise an actuatable mechanism that releases the light fixture from a fixed position when actuated to enable variable positioning of the light fixture.

6 Claims, 11 Drawing Sheets

LIGHT FIXTURE

CROSS REFERENCE TO RELATED APPLICATION

This application is a continuation of U.S. patent application Ser. No. 11/906,921, entitled "LIGHT FIXTURE," filed on Oct. 4, 2007, by Max A. Probasco, et al., which is currently pending and is incorporated herein by reference as if reproduced herein in its entirety.

BACKGROUND

Artists, photographers, painters and other professionals often use utility lights to illuminate work areas. However, these utility lights are generally difficult to transport, are susceptible to being tipped over and/or damaged, and are inconvenient to use and store.

DETAILED DESCRIPTION OF THE DRAWINGS

The preferred embodiments and the advantages thereof are best understood by referring to FIGS. 1A-5 of the drawings, like numerals being used for like and corresponding parts of the various drawings.

Figure 1A:
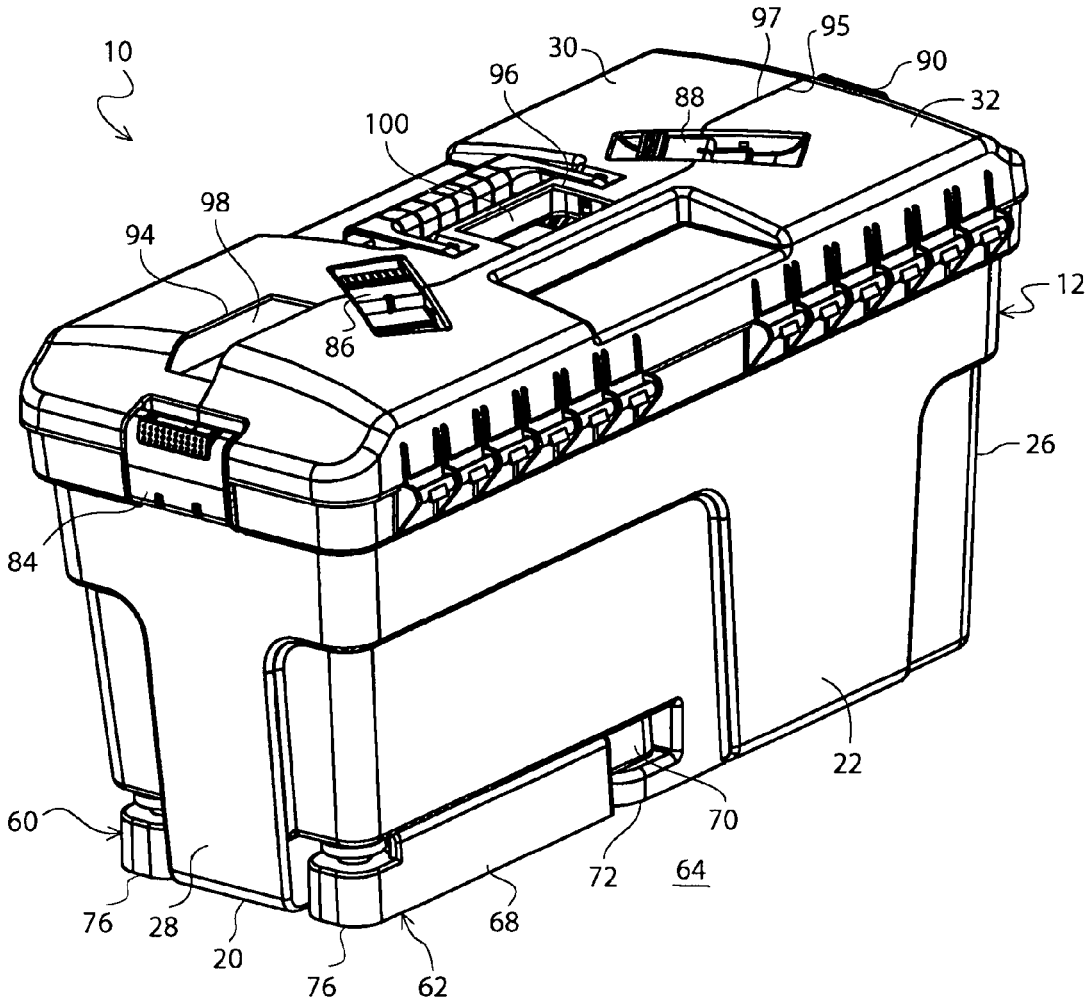
FIGS. 1A-1D are diagrams illustrating an embodiment of a portable lightbox assembly.
Figure 1B:
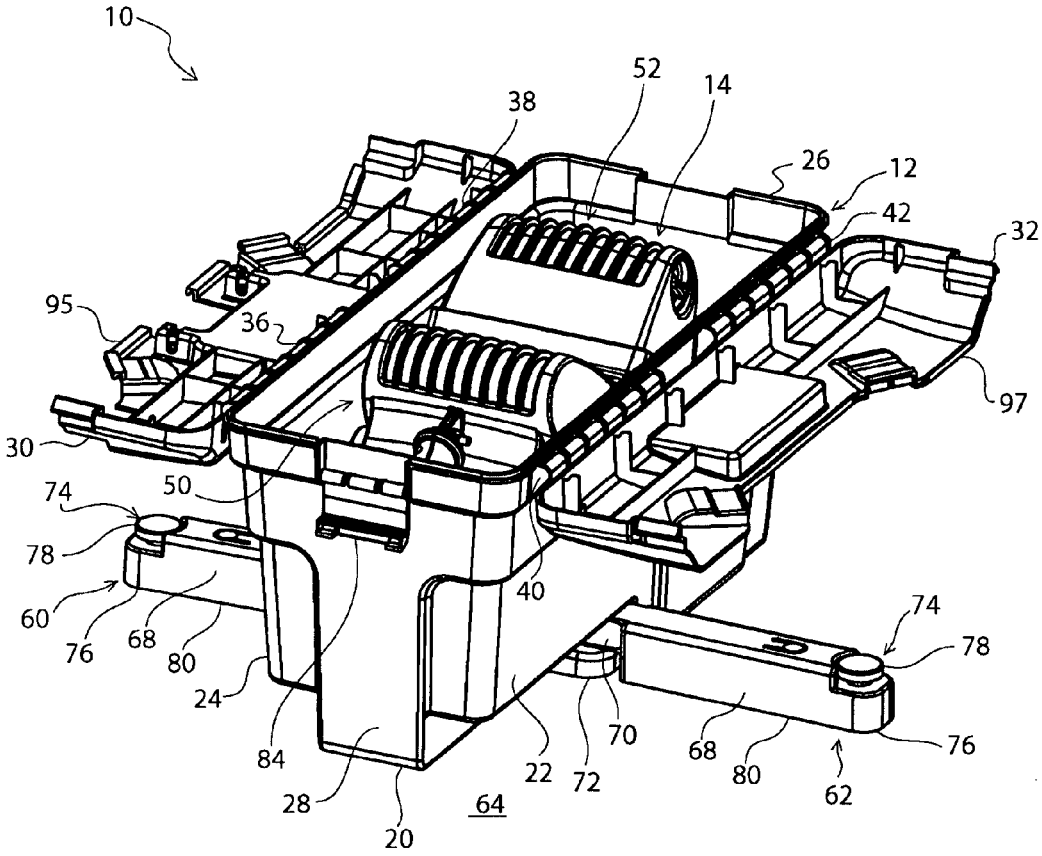
Figure 1C:
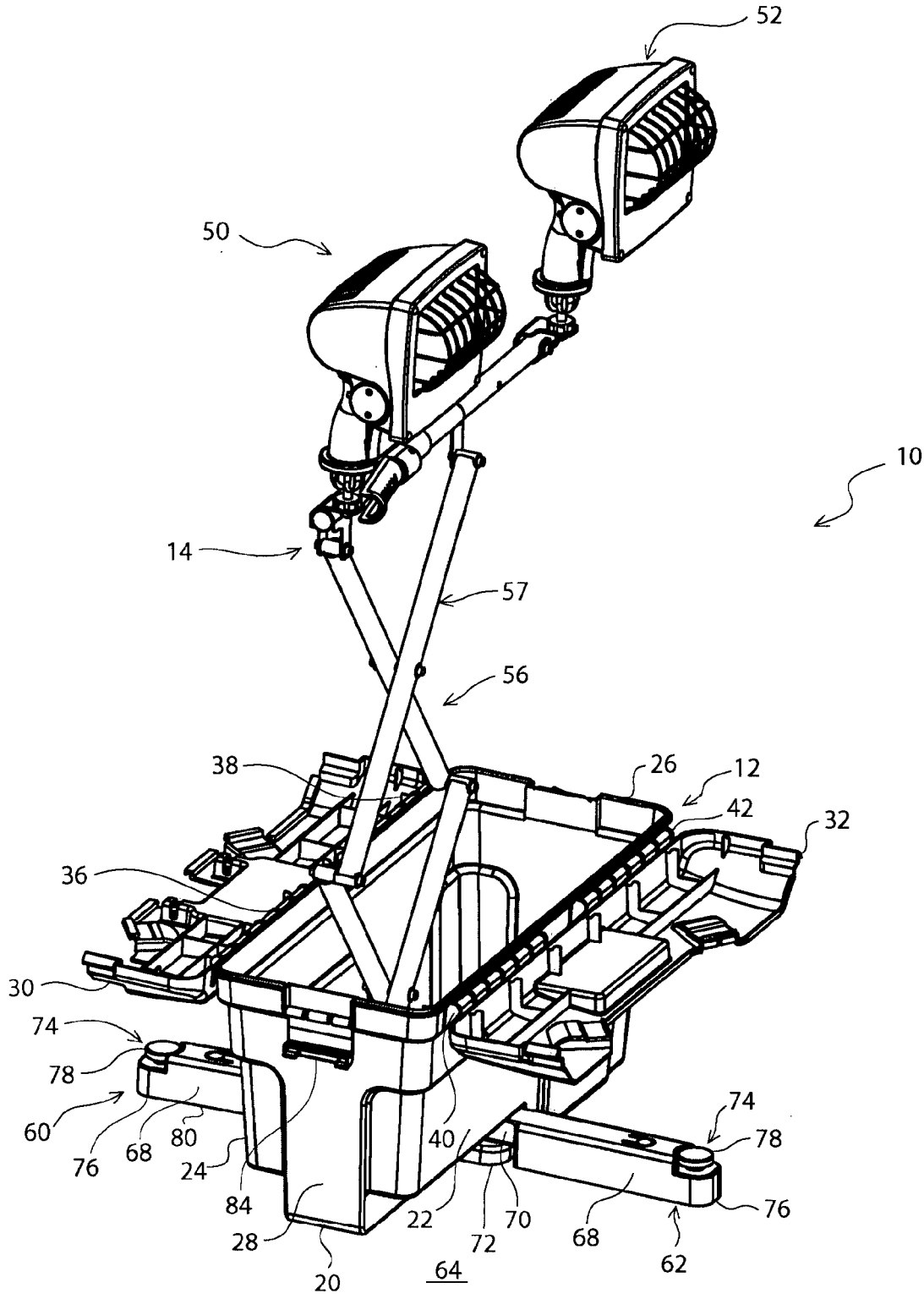

FIGS. 1A-1D are diagrams illustrating an embodiment of a portable lightbox assembly 10. In the embodiment illustrated in FIGS. 1A-1D, lightbox assembly 10 comprises a housing 12 that is sized and/or otherwise configured for portability and for storing therein a light assembly 14. For example, in the illustrated embodiment, housing 12 comprises an enclosure formed of a number of walls for enclosing therein in a stored position light assembly 14. In FIGS. 1A-1D, housing 12 comprises a base or bottom wall 20, side walls 22, 24, 26, and 28, and covers 30 and 32. In the illustrated embodiment, housing 12 comprises a generally rectangular configuration. However, it should be understood that housing 12 may be otherwise configured having other shapes and/or sizes. In the illustrated embodiment, covers 30 and 32 are rotatably coupled to respective walls 24 and 22 via respective hinge assemblies 36, 38, 40 and 42 to enable covers 30 and 32 to be rotated relative to walls 24 and 22 between a closed position (FIGS. 1A and 1D) and an open position (FIGS. 1B and 1C). However, it should be understood that a greater or lesser quantity of covers may be used with housing 12 to enclose housing 12

Figure 1D:
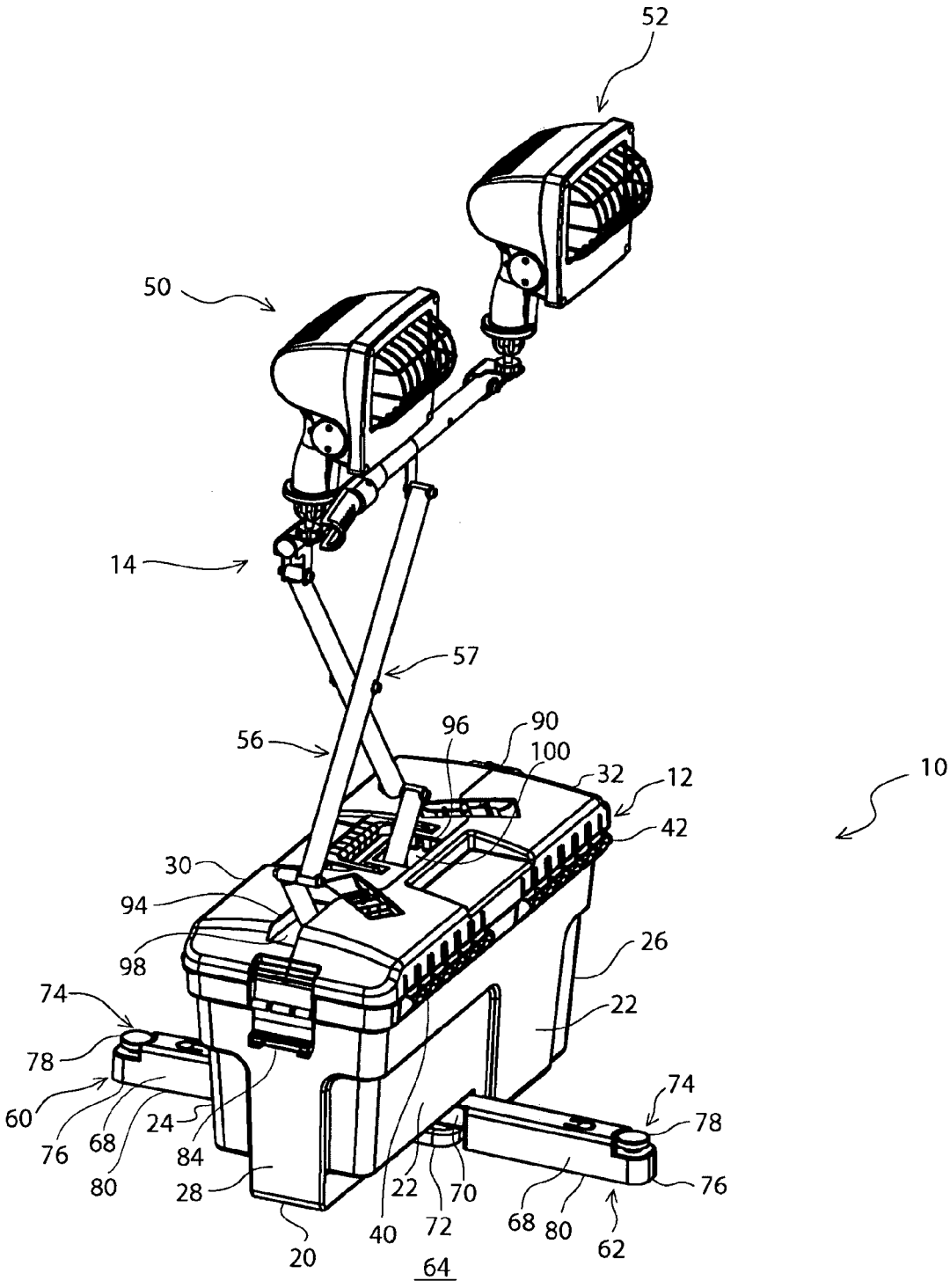

In the embodiment illustrated in FIGS. 1A-1D, light assembly 14 comprises light fixtures 50 and 52 coupled to a lift mechanism 56. In FIGS. 1A-1D, lift mechanism 56 comprises a scissor lift mechanism 57; however, it should be understood that other types and/or configurations of mechanisms may be used to move light fixtures 50 and 52 from a stored position within housing 12 to an extended position relative to housing 12. Further, it should be understood that a greater or fewer quantity of light fixtures may be used in light box assembly 10. Lift mechanism 56 enables light assembly 14 to be moved between a retracted or stored position within housing 12 (FIGS. 1A and 1B) to an extended position protruding beyond housing 12 (FIGS. 1C and 1D). In the illustrated embodiment, housing 12 comprises stabilizers 60 and 62 for stabilizing light box assembly 10 relative to a support surface 64 such as a floor, table or other type of surface upon which light box assembly 10 is placed. In the illustrated embodiment, stabilizers 60 and 62 each comprise and elongate member 68 having an end 70 rotatably coupled to a bottom portion 72 of housing 12 (e.g., via a pin or other type of rotatable element) to facilitate extendable movement of stabilizer 60 and 62 from a retracted or stored position (FIG. 1A) to an extended position (FIGS. 1B-1D) relative to housing 12. However, it should be understood that stabilizers 60 and 62 may be otherwise coupled to housing 12 to facilitate extendable movement relative to housing 12 (e.g., telescopic, translational, etc.) such that at least a portion of stabilizers 60 and 62 are locatable beyond a perimeter of housing 12 to prevent light box assembly 10 from becoming unbalanced and/or otherwise tipping over (especially when light assembly 14 is in an extended position relative to housing 12). Further, in the embodiment illustrated in FIGS. 1A-1D, two stabilizers 60 and 62 are used. However, it should be understood that a greater or fewer quantity of stabilizers may be used in light box assembly 10.

In the illustrated embodiment, each stabilizer 60 and 62 also comprises a height adjustment mechanism 74 disposed at or near and end 76 of elongate member 68 opposite ends 70 to compensate for support surface 64 irregularities. For example, in the illustrated embodiment, height adjustment mechanisms 74 comprise a thumbwheel 78 threadably coupled to elongate member 68 and extending through elongate member 68 to facilitate contact thereof with support surface 64. Thus, in operation, to compensate for unevenness and/or other irregularities in support surface 64, thumbwheel (s) 78 may be rotated in a desired direction to facilitate extension or retraction of height adjustment mechanism 74 relative to a bottom surface 80 of extension member 68 to seat height adjustment mechanisms 74 against support surface 64. However, it should be understood that other types of methods or mechanisms may be used to compensate for unevenness or other irregularities of support surface 64.

In the illustrated embodiment, housing 12 comprises latch elements 84, 86, 88, and 90 for releasably securing covers 30 and 32 in a closed position relative to housing 12. It should be understood that a greater or fewer quantity of latch mechanisms and/or different types of mechanisms may be used for releasably securing covers 30 and 32 in a closed position relative to housing 12. As best illustrated in FIGS. 1A and 1D, cover 30 comprises recessed portions 94 and 96 located along a side 95 of cover 30. Side 95 of cover 30 generally cooperates with a side 97 of cover 32 to enclose housing 12. When covers 30 and 32 are in a closed position relative to housing (FIGS. 1A and 1D, recessed portions 94 and 96 cooperate with corresponding portions of side 97 of cover 32 to form openings 98 and 100, respectively, through a top portion of housing 12, thereby enabling portions of light assembly 14 to extend therethrough when covers 30 and 32 are in a closed position relative to housing 12 and when light assembly 14 is located in an extended position relative to housing 12. For example, as best illustrated in FIG. 1D, recessed portions 94 and 96 of cover 30 cooperate with cover 32 to form openings 98 and 100 extending through a top portion of housing 12 when covers 30 and 32 are in a closed position on housing 12, thereby enabling light assembly 14 to be located in an extended position relative to housing 12 while covers 30 and 32 are disposed in a closed position over housing 12. Thus, embodiments of light box assembly 10 enable light assembly 14 to be located in an extended position relative to housing 12 while also closing housing 12, thereby preventing tools, debris or other materials from entering housing 12.

Figure 2A:
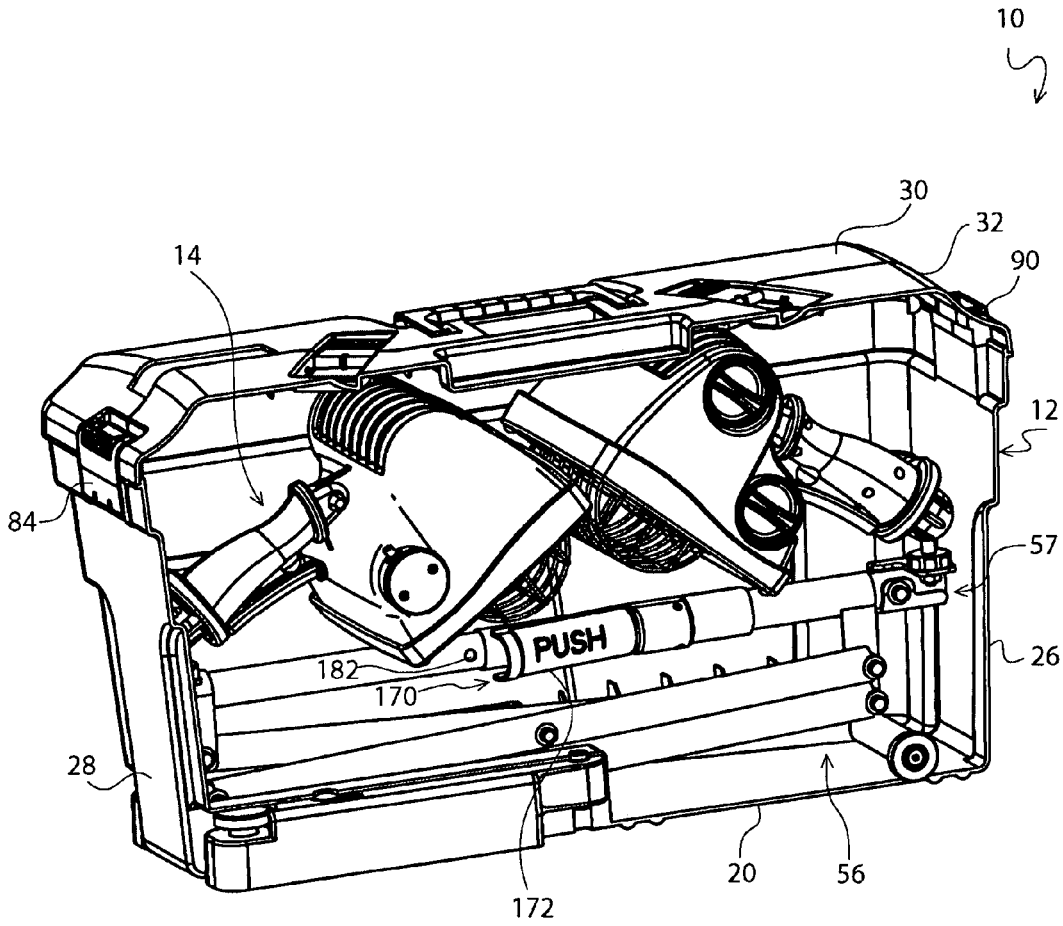
FIGS. 2A-2B are diagrams illustrating the lightbox assembly of FIGS. 1A-1D with a portion of a housing of the lightbox assembly broken away.
Figure 2B:
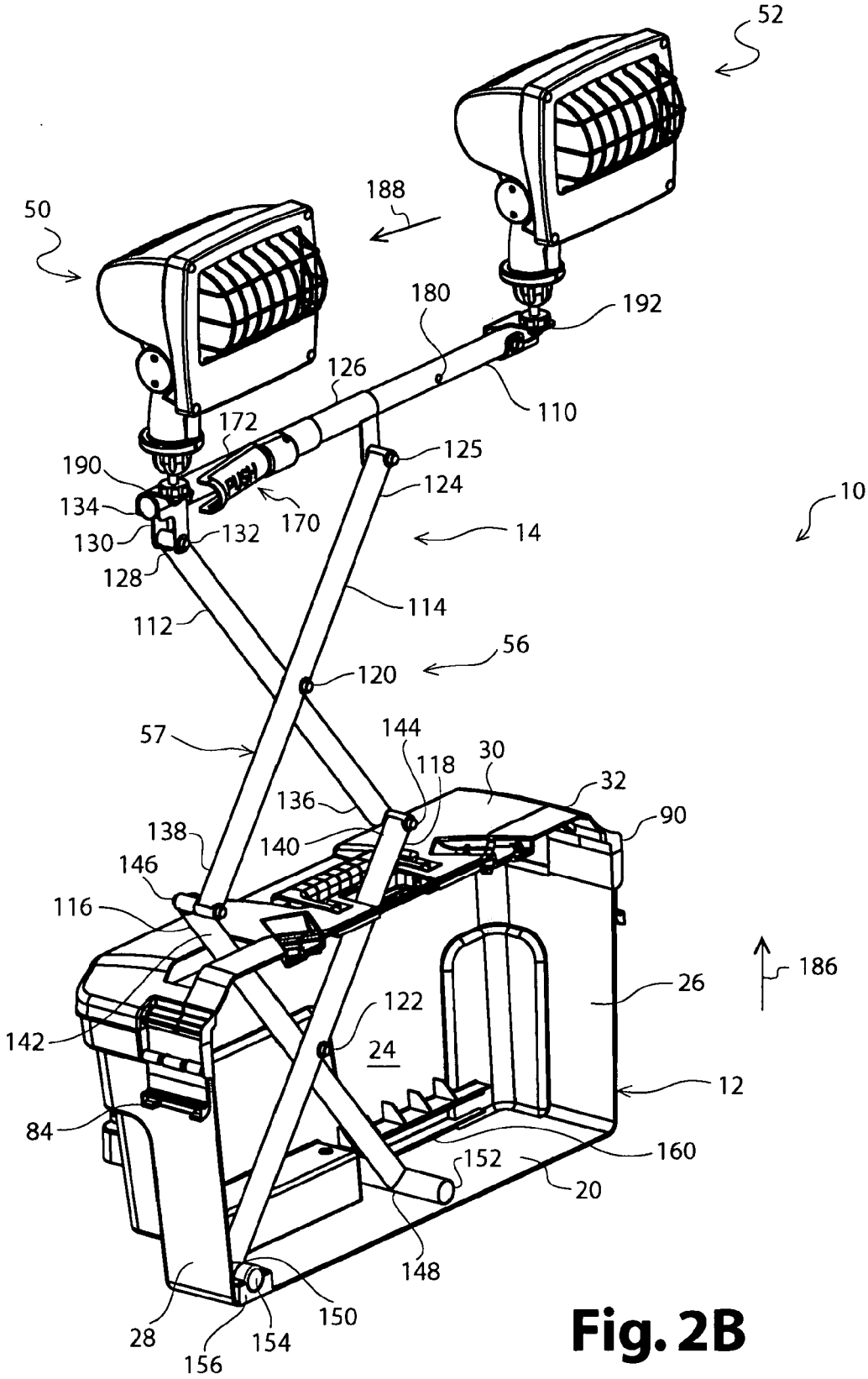

FIGS. 2A and 2B are diagrams illustrating light box assembly 10 of FIGS. 1A-1D with a portion of housing 12 broken away. In FIG. 2A, light assembly 14 is illustrated in a retracted or stored position within housing 12, and FIG. 2B illustrates light assembly 14 in an extended position relative to housing 12. Referring to FIGS. 1A-1D and 2A-2B, scissor lift mechanism 57 comprises a crossbar member 110 and support members 112, 114, 116, and 118. Support members 112 and 114 are rotatably coupled to each other at respective medial locations thereof via a pin member 120, and support members 116 and 118 are rotatably coupled to each other at respective medial locations via a pin member 122. An end 124 of support member 114 is rotatably coupled via a pin member 125 to a support member 126 which, in turn, is translatably and/or slideably coupled to crossbar member 110. An end 128 of support member 112 is rotatably coupled to a support member 130 via a pin member 132, and support member 130 is fixedly coupled to an end 134 of crossbar member 110. Ends 136 and 138 of respective support members 112 and 114 are rotatably coupled to ends 140 and 142 of respective support members 118 and 116 via pin members 144 and 146. Ends 148 and 150 of respective support members 116 and 118 terminate in a T-shaped configuration via respective support members 152 and 154. Support member 154 is rotatably coupled to a base portion 156 of housing 12, and support member 152 is translatably and/or slideably coupled to housing 12 via a track 160 located in a bottom portion of housing 12. Thus, in operation, slideable movement of support member 152 within track 160 causes scissor lift mechanism 57 to extend and retract relative to housing 12, thereby causing extension and retraction of light assembly 14 relative to housing 12.

In the illustrated embodiment, light assembly 14 also comprises a locking mechanism 170 for releasably securing light assembly 14 in an extended or retracted/stored position relative to housing 12. For example, in some embodiments, locking mechanism 170 comprises an actuatable handle 172 that is biased to an unactuated position (e.g., via a spring, clip, or other type of biasing mechanism). In the illustrated embodiment, locking mechanism 170 is disposed on and/or is otherwise coupled to support member 126 to facilitate lifting and/or lowering of light assembly 14 relative to housing 12. In the illustrated embodiment, crossbar member 110 comprises openings 180 (FIG. 2B) and 182 (FIG. 2A) that are releasably engaged by locking mechanism 170 to releasably secure light assembly 14 in a retracted/stored position or extended position, respectively, For example, referring to FIG. 2A, light assembly 14 is illustrated in a retracted/stored position within housing 12. In the retracted/stored position, locking mechanism 170 engages opening 180 (FIG. 2B) (e.g., via a pin or other structure) to releasably secure light assembly 14 in the retracted/stored position. As described above, in some embodiments, locking mechanism 170 is biased to an unactuated position which also corresponds to a locking position of locking mechanism 170 such that locking mechanism 170 is biased toward engagement with one of openings 180 and 182. For example, referring to FIG. 2A, to release light assembly 14 from a secured retracted/stored position, locking mechanism 170 is actuated (e.g., by squeezing handle 172 relative to crossbar member 110 and/or support member 126), thereby disengaging locking mechanism 170 from opening 180. After locking mechanism 170 is disengaged from opening 180, light assembly 14 may be lifted upwardly (e.g., by lifting crossbar member 110 and/or support member 126 in the direction indicated by arrow 186 (FIG. 2B)) toward an extended position relative to housing 12. In response to upward movement of light assembly 14 relative to housing 12, support member 126 is translated along crossbar member 110 in the direction indicated by arrow 188 toward opening 182 (FIG. 2A). Thus, as light assembly 114 is moved upwardly in the direction of arrow 186 toward an extended position relative to housing 12, locking mechanism 170 is translated along crossbar member 110 in the direction 188 where, in response to locking mechanism 170 reaching opening 182, locking mechanism 170 engages opening 182 to releasably secure light assembly 14 in the extended position. It should be understood that the release and lowering of light assembly 14 from the extended position may be performed in reverse order. Additionally, in the illustrated embodiment, opening 180 enables locking mechanism to releasably secure light assembly 14 in a retracted position within housing 12 independently of any other elements (e.g., independently of using covers 30 and/or 32 to secure light assembly 14 within housing 12), thereby preventing light assembly 14 from inadvertently extending from housing 12 (e.g., in response to housing 12 being tipped over, etc.). It should also be understood that other types of methods and/or mechanisms may be used to releasably secure light assembly 14 in one or more different positions relative to housing 12.

In the illustrated embodiment, light fixtures 50 and 52 are disposed at opposite ends of crossbar member 110 via bracket assemblies 190 and 192, respectively. However, it should be understood that light fixtures may be otherwise located on light assembly 14. In some embodiments, light fixtures 50 and 52 are pivotally coupled to bracket assemblies 190 and 192 and/or crossbar member 110 to facilitate directionally control of light emitted by light fixtures 50 and 52 and enabling variable positioning of light fixtures 50 and 52 to facilitate storage of light assembly 14 within housing 12 (e.g., such as in the positions illustrated in FIG. 2A). In some embodiments, electrical conduits and/or cables extend through and/or within one or more support members 110, 112, 114, 116 and 118 to enable a power source to be coupled to light assembly 14 and/or light fixtures 50 and 52.

Figure 3A:
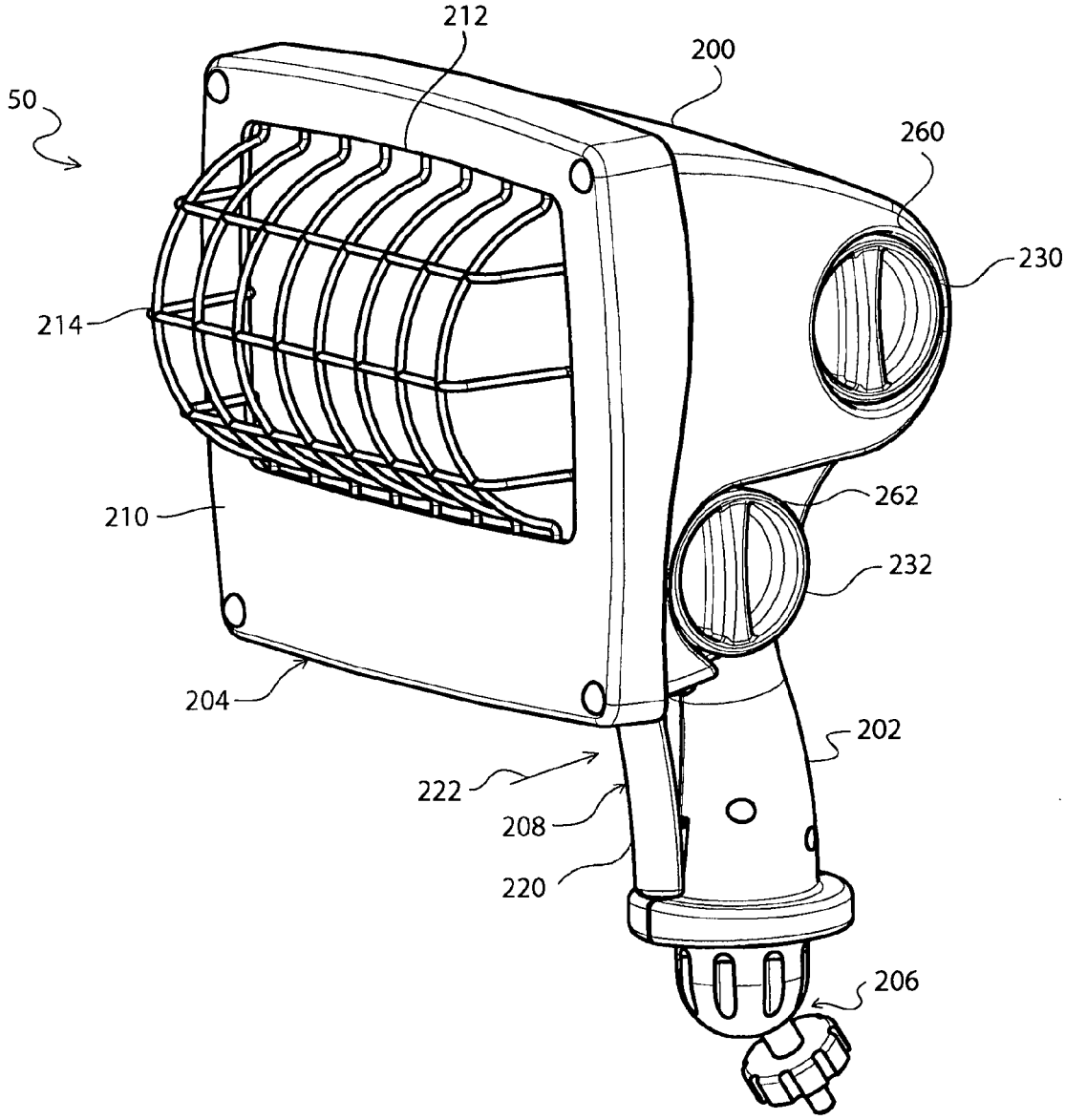
FIGS. 3A-3C are diagrams illustrating an embodiment of a light fixture of the lightbox assembly of FIGS. 1A-1D.
Figure 3B:
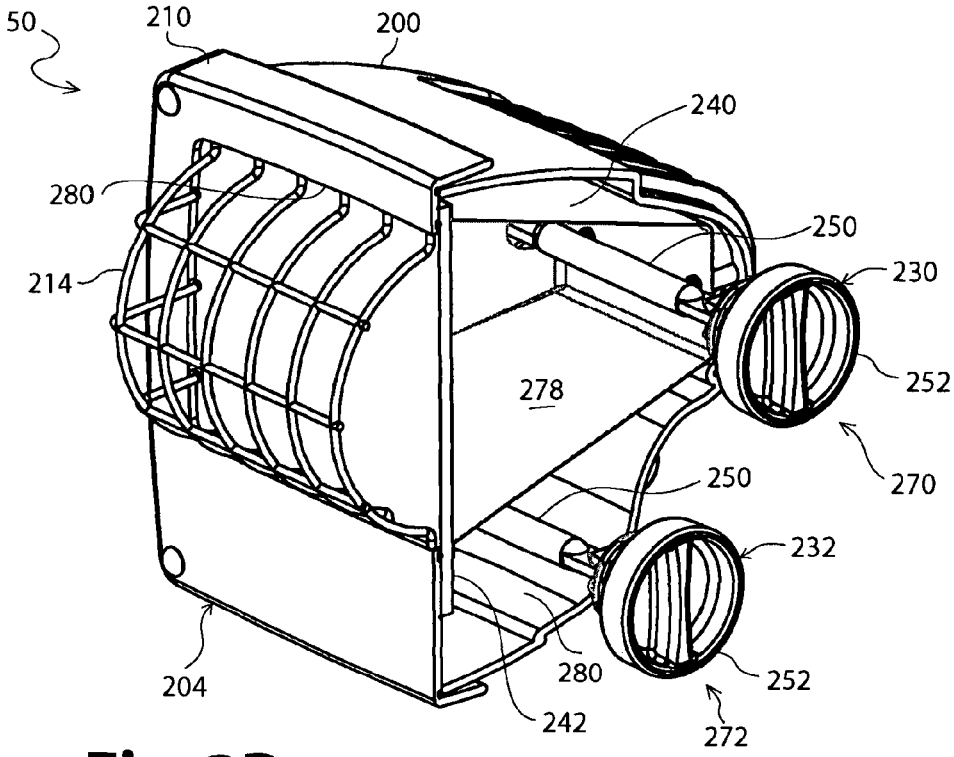
Figure 3C:
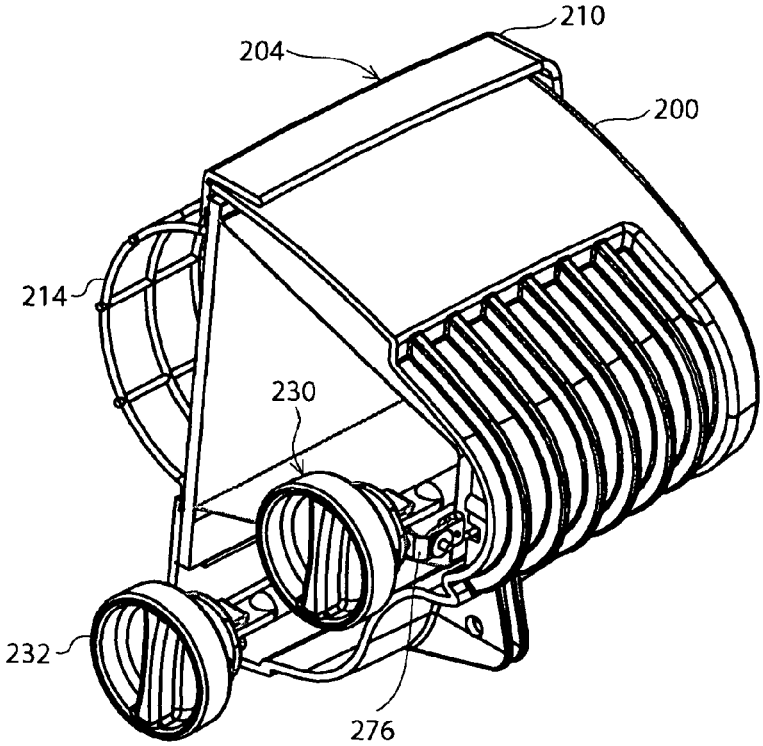

FIGS. 3A-3C are diagrams illustrating an embodiment of light fixtures 50 and/or 52. For ease of understanding and illustration, FIGS. 3A-3C will be described in connection with light fixture 50. However, it should be understood that light fixture 52 may be similarly configured. In the embodiment illustrated in FIGS. 3A-3C, light fixture 50 comprises a housing 200, a handle 202, a cover assembly 204, a coupling assembly 206, and an actuation mechanism 208. In the illustrated embodiment, cover assembly 204 comprises a front cover 210 having an opening 212 formed therein to enable light emitted by light fixture 50 to pass therethrough. Front cover 210 is coupled to a forward-facing portion of housing 200 and, in some embodiments, comprises a protective grill 214. Cover assembly 204 may be coupled to housing 200 using fasteners, clips, a press fit or frictional engagement arrangement, or otherwise.

Coupling assembly 206 is used to couple light fixture 50 to bracket assembly 190 (FIG. 2B) and facilitate variable directional movement of light fixture 50 such that light fixture 50 may be releasably secured in a variety of different positions and/or angular orientations relevant to crossbar member 110 (FIG. 2B). Actuation mechanism 208 is coupled to coupling assembly 206 (e.g., within handle 202) and is used to releasably secure light fixture 50 in a desired position and/or angular orientation relative to bracket assembly 190 (FIG. 2B). For example, in some embodiments, actuation mechanism 208 comprises a handle member 220 that is biased away from handle 202 to a locking position to secure light fixture 50 in a desired position and/or angular orientation. Thus, in some embodiments, actuation of locking mechanism 208 (e.g., by applying a force to handle member 220 in the direction indicated by arrow 222) toward handle 202 causes movement of handle member 220 toward handle 202 and further causes light fixture 50 to be released or unlocked from a secured position to enable variable movement of light fixture 50 relative to bracket assembly 190 (FIG. 2B). In some embodiments, coupling assembly 206 comprises a ball joint assembly that may be transitioned between a locked and unlocked configuration via actuation of mechanism 208. Thus, in operation, to adjust a position and/or angular orientation of light fixture 50 relative to light assembly 14, a force is applied to handle member 220 (e.g., by squeezing handle member 220 toward handle 202), thereby releasing coupling assembly 206 from a locked position and enabling light fixture 50 to be freely pivoted and/or rotated relative to bracket assembly 190 (FIG. 2B). After light fixture 50 has been located in a desired position and/or angular orientation, release of mechanism 208 causes coupling assembly 206 to return to a locked configuration, thereby securing light fixture 50 in the desired position/orientation. In some embodiments, handle member 220 is biased away from handle 202 and/or in a direction opposite direction 222 such that upon cessation of a force in the direction of 222, handle member 220 returns to an unactuated position, thereby facilitating the return of coupling assembly 206 to a locked configuration. However, it should be understood that actuation mechanism 208 may be otherwise configured.

In the illustrated embodiment, housing 200 is configured to store therein two light bulb assemblies 230 and 232. However, it should be understood that in some embodiments, light fixture 50 may be configured to house therein a single light bulb assembly. Referring to FIG. 3B, a portion of housing 200 and cover assembly 204 are broken away to illustrate in interior area of light fixture 50. In the embodiment illustrated in FIGS. 3B and 3C, light fixture 50 comprises a reflector 240 and a transparent cover 242 disposed within housing 200. In the illustrated embodiment, light bulb assemblies 230 and 232 each comprise a light bulb 250 coupled to a locking member 252. Locking member 252 is configured to releasably engage housing 200 to facilitate releasably securing of light bulb assemblies 230 and 232 to housing 200. For example, referring to FIG. 3A, housing 200 comprises openings 260 and 262 for receiving therethrough respective light bulb assemblies 230 and 232. In some embodiments, locking element 252 is configured to releasably engage, in an interchangeable fashion, either of openings 260 or 262 such that light bulb assemblies 230 and 232 may be interchangeable between positions corresponding to openings 260 and 262. Locking elements 252 and/or housing 200 may be configured for threadable engagement therebetween, frictional engagement, or otherwise to facilitate releasably securing light bulb assemblies 230 and 232 within housing 200

In the illustrated embodiment, light bulb assemblies 230 and 232 are located at two different positions 270 and 272, respectively, relative to housing 200 where position 270 corresponds to opening 260 and position 272 corresponds to opening 262. In the illustrated embodiment, position 272 corresponds to a storage location within housing 200 for a spare light bulb assembly (e.g., light bulb assembly 232) and position 270 corresponds to an illumination location for a light bulb assembly within housing 200 (e.g., light bulb assembly 230). For example, in some embodiments, housing 200 comprises one or more electrical contacts 276 for electrically engaging and/or otherwise coupling a light bulb assembly located at position 270 to a power source to facilitate illumination of the corresponding light bulb assembly located at position 270. In the illustrated embodiment, position 270 of housing 200 is configured such that a light bulb assembly located therein (e.g., light bulb assembly 230) is located in front of reflector 240 (e.g., in front of and/or otherwise within a reflective area 278 of reflector 240) to facilitate emission of light from the light bulb assembly located at position 270 through cover 242 and/or otherwise outwardly through an opening 280 in cover assembly 204. Position 272 of housing 200 is configured without electrical contacts such that a light bulb assembly located at position 272 is positioned within an enclosed cavity 280 within housing 200 (e.g., a location within housing 200 located below and/or external to reflective area 278) such that the light bulb assembly located at location 272 is a spare light bulb assembly that can be readily interchanged with a light bulb assembly located at position 270 (e.g., in response to a light bulb assembly located at position 270 reaching its maximum light-producing life).

Figure 4A:
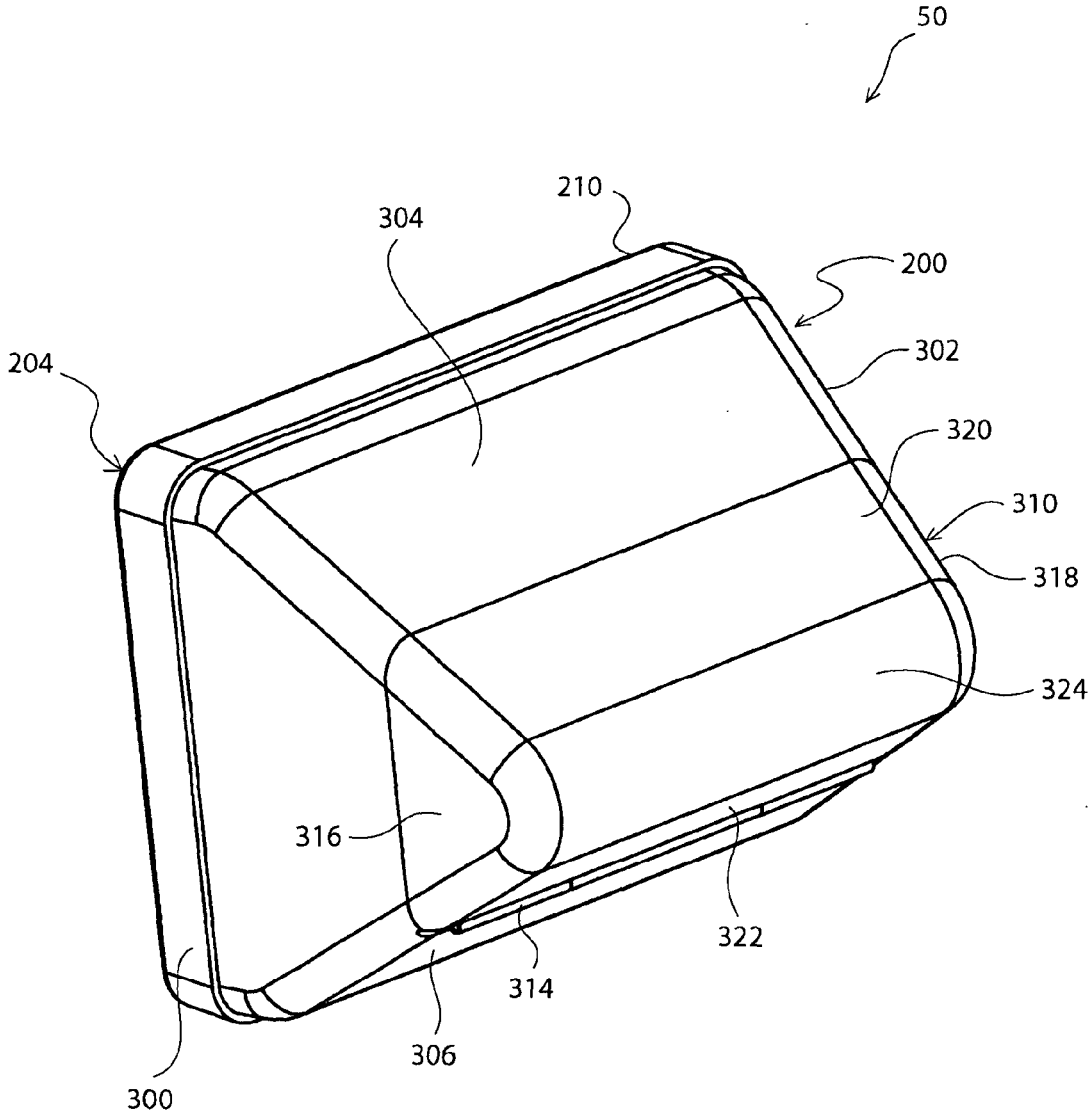
FIG. 4A-4B are diagrams illustrating another embodiment of a light fixture of the lightbox assembly of FIGS. 1A-1D.
Figure 4B:
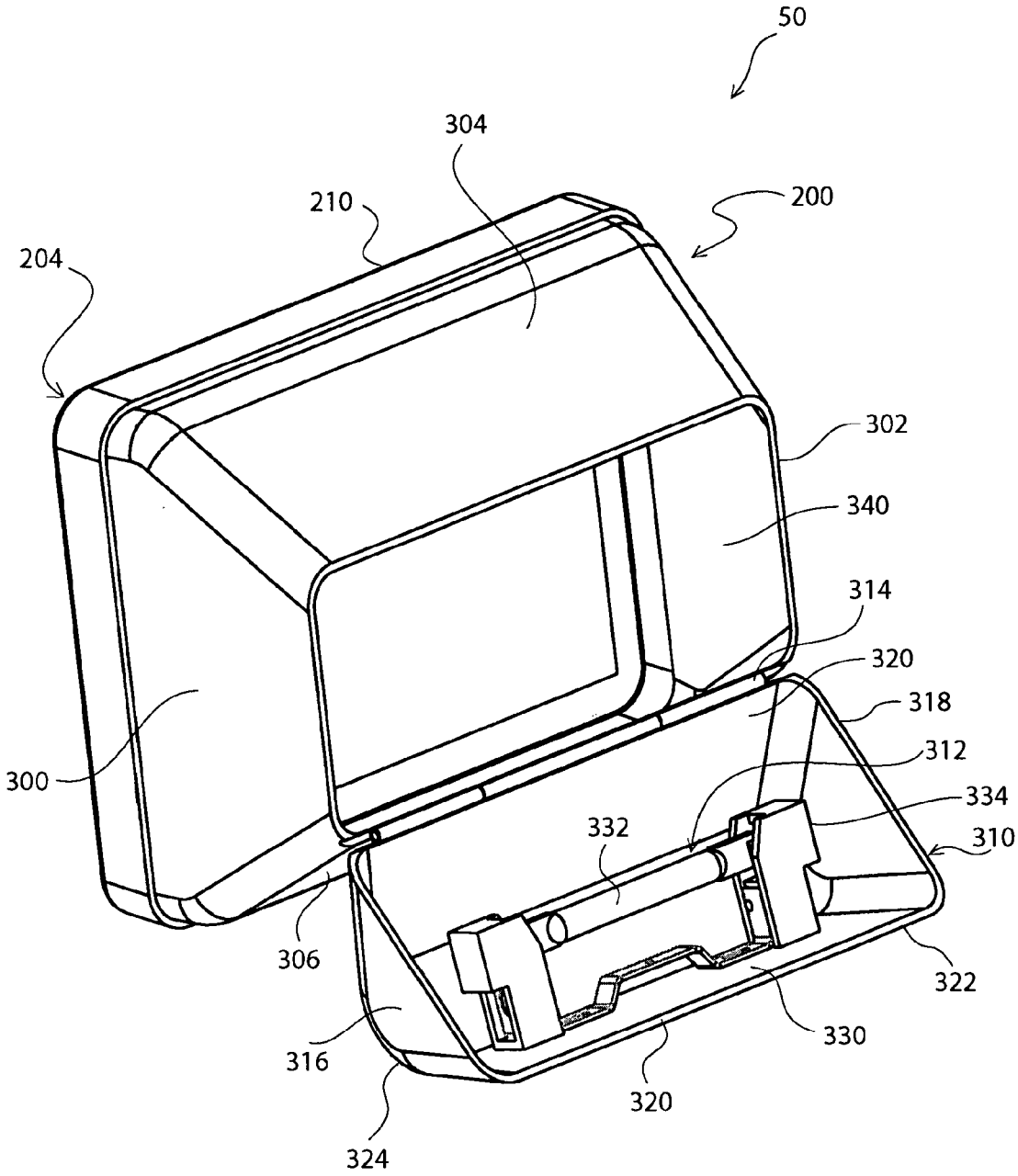

FIGS. 4A and 4B are diagrams illustrating another embodiment of light fixtures 50 and/or 52. For ease of understanding and illustration, FIGS. 4A and 4B will be described in connection with light fixture 50. However, it should be understood that light fixture 52 may be similarly configured. In the embodiment illustrated in FIGS. 4A and 4B, light fixture 50 comprises housing 200 having cover assembly 204 with front cover 210 coupled thereto as described above. In FIGS. 4A and 4B, housing 200 comprises side walls 300 and 302, an upper wall 304, and a lower wall 306. Walls 300, 302, 304 and 306 extend rearwardly in a direction away from cover assembly 204 and/or a light-emitting area of light fixture 50. In the embodiment illustrated in FIGS. 4A and 4B, walls 300, 302, 304 and 306 are disposed at converging angles such that walls 300 and 302 are angled inwardly toward each other as walls 300 and 302 extend rearwardly, and walls 304 and 306 are angled inwardly toward each other as walls 304 and 306 extend rearwardly. Thus, in FIGS. 4A and 4B, housing 200 comprises a generally pyramid-shaped housing; however, it should be understood that housing 200 may be otherwise configured.

In the embodiment illustrated in FIGS. 4A and 4B, housing 200 comprises a door 310 located at a rearward portion of housing 200 that is openable relative to a forward portion of housing 200 to facilitate access to and/or otherwise replacement of a light bulb assembly 312 for light fixture 50. In FIGS. 4A and 4B, door 310 is rotatably coupled to lower wall 306 via a hinge assembly 314 to facilitate rotatable movement of door 310 relative to the forward portion of housing 200. However, it should be understood that door 310 may be rotatably coupled to a different portion of housing 200 (e.g., rotatably coupled to top wall 304, side wall 300 and/or side wall 302). In FIGS. 4A and 4B, door 310 comprises side walls 316 and 318, an upper wall 320, a lower wall 322, and a rear wall 324. Walls 316, 318, 320 and 322 are configured to be positioned at angles corresponding to walls 300, 302, 304 and 306 such that the surfaces of door 310 adjoin adjacent surfaces of the forward portion of housing 200 in a smooth transition when door 310 is in a closed position (e.g., as illustrated in FIG. 4A). However, it should be understood that door 310 may be otherwise configured.

As best illustrated in FIG. 4B, light bulb assembly 312 is disposed within and/or is otherwise coupled to an interior portion of door 310. For example, in FIG. 4B, light bulb assembly 312 is coupled to an interior surface 330 of wall 320. However, it should be understood that light bulb assembly 312 may be otherwise coupled to different portions of door 310. Thus, in operation, door 310 is openable and closeable relative to the forward portion of housing 200 to facilitate insertion and/or removal of a light bulb 332 relative to a socket frame 334 of light bulb assembly 312. Socket frame 334 is coupled to the interior portion of door 310 and is electrically coupled and/or couplable to a power supply for providing power to light bulb 332. For example, in some embodiments, socket frame 334 may be positioned on door 310 to automatically engage electrical contacts disposed within housing 200 when door 310 is in a closed position, thereby facilitating a power supply to light bulb 332 (e.g., only when door 310 is in a the closed position). In other embodiments, electrical conduits may extend from housing 200 to door 310 and/or socket frame 334 for providing a power supply to light bulb 332. Thus, in operation, opening of door 310 relative to the forward portion of housing 200 results in light bulb assembly 312 moving therewith such that light bulb assembly 312 is withdrawn from an interior area 340 of housing 200, thereby facilitating ready access for inserting/removing light bulb 332 relative to socket frame 334. In the embodiment illustrated in FIGS. 4A and 4B, housing 200 is illustrated having a single door 310. However, it should be understood that housing 200 may be configured having multiple doors 310. For example, in some embodiments, housing 200 may be configured having at least two doors 310 where one door 310 has a spare light bulb coupled thereto and another door 310 has a light bulb coupled thereto that is illuminated and/or otherwise installed to receive an electrical current thereto.

Figure 5:
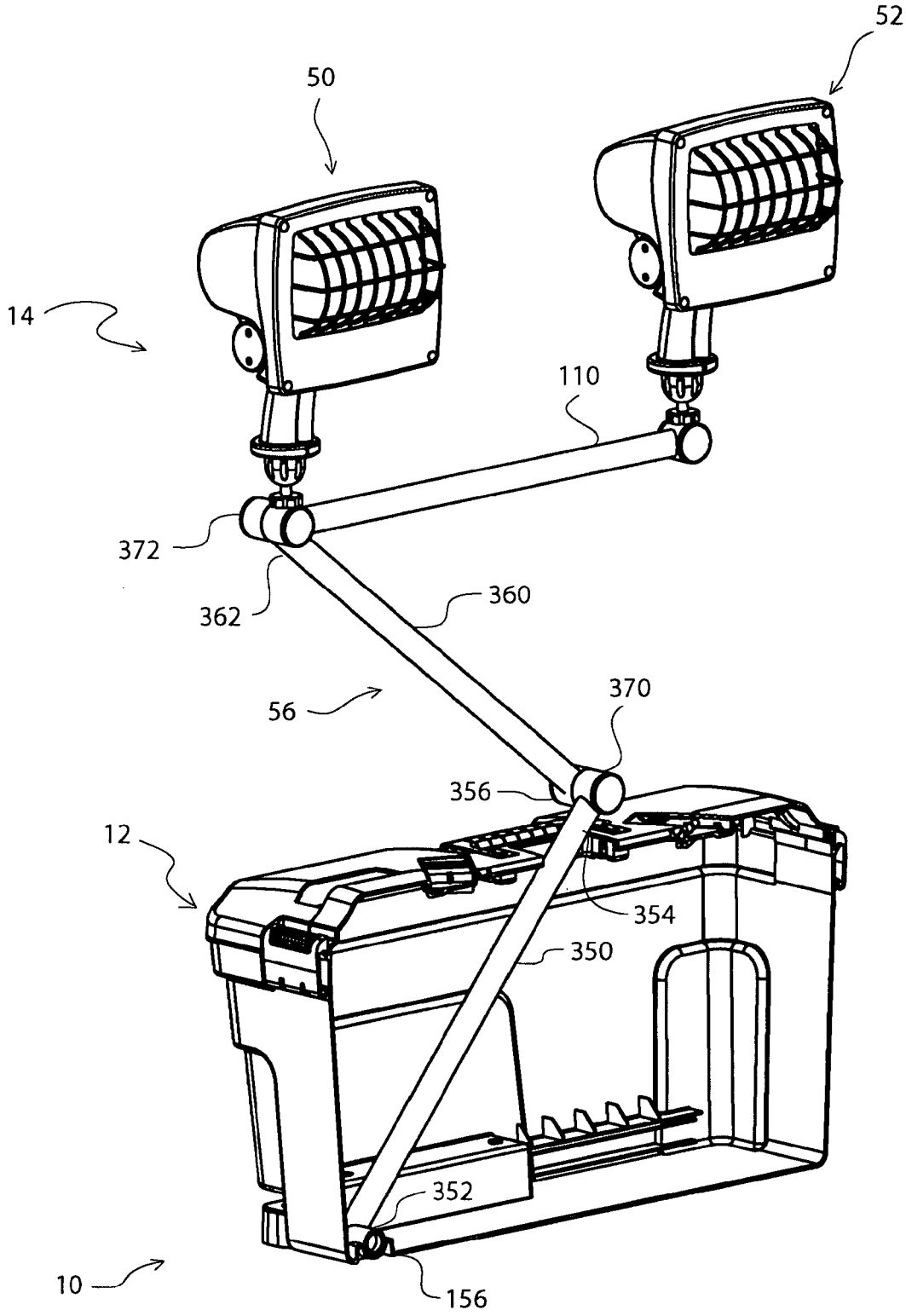
FIG. 5 is another diagram illustrating an embodiment of a lightbox assembly

FIG. 5 is a diagram illustrating another embodiment of portable light box assembly 10. In the embodiment illustrated in FIG. 5, lift mechanism 56 comprises a support member 350 having an end 352 rotatably coupled to base portion 156 of housing 12, and an end 354 rotatably coupled to an end 356 of a support member 360. An opposite end 362 of support member 360 is rotatably coupled to crossbar member 110. In the embodiment illustrated in FIG. 5, lift mechanism 56 comprises locking mechanisms 370 and 372 to enable variable positioning of support members 350 and 360 relative to each other and variable positioning of support member 360 relative to crossbar member 110, respectively. In some embodiments, locking mechanisms 370 and 372 comprise push-button mechanisms of a ratchet-based configuration to enable support members 350, 360 and crossbar member 110 to be releasably secured at various angular positions and/or orientations relative to each other. However, it should be understood that other types of mechanisms may be used to control the variable positioning of support members 350, 360 and crossbar member 110 relative to each other.

Thus, in operation, actuation of locking mechanisms 370 and 372 enable lift mechanism 56 to be placed at various elevational positions relative to housing 12 to enable light fixtures 50 and 52 to be retracted into housing 12 in a stored position and elevated to an extended position relative to housing 12 (as illustrated in FIG. 5). Thus, for example, locking mechanisms 370 and 372 are actuatable to enable support members 350 and 360 and cross member 110 to be located in a retracted position within housing 12 (e.g., such that support members 350 and 360 and crossbar member 110 are disposed substantially adjacent and/or nearly parallel with each other within housing 12). Actuation of locking mechanisms 370 and 372 also enables support members 350 and 360 and crossbar member 110 to be lifted and/or extended outwardly from housing 12 to facilitate location of light fixtures 50 and 52 in one or more extended positions relative to housing 12. Thus, locking mechanisms 370 and/or 372 enable variable elevational and/or extended positioning of light fixtures 50 and/or 52 relative to housing 12.

Thus, embodiments of lightbox assembly 10 provide an extendable and retractable light assembly 10 that is portable and is easily configurable between extended and retracted positions. Further, embodiments of lightbox assembly 10 enable light assembly 14 to be located in an extended position relative to housing 12 while also enabling housing 12 to be closed (e.g., covers 30 and 32 located in a closed position), thereby substantially or completely eliminating unwanted materials or debris from entering housing 12 while light assembly 14 is in use and/or otherwise located in an extended position. Additionally, embodiments of lightbox assembly 10 provide light fixture(s) 50 and 52 having onboard locations to store secondary and/or spare light bulb assemblies, thereby providing easy interchangeability of light bulb assemblies for light fixture(s) 50 and 52.

What is claimed is:

1. A light fixture, comprising: a housing configured to enclose a plurality of light bulbs therein, wherein at least one of the light bulbs is located in a non-illumination position within the housing.

2. The light fixture of claim 1, wherein the at least one light bulb is interchangeable with a light bulb located in an illumination position within the housing.

3. The light fixture of claim 1, further comprising a cover assembly coupled to the housing and configured to enable light emitted by at least one of the light bulbs to pass therethrough, and wherein the plurality of light bulbs are insertable into the housing without removal of the cover assembly from the housing.

4. The light fixture of claim 1, wherein the plurality of light bulbs are insertable into the housing from a side portion of the housing.

5. The light fixture of claim 1, further comprising a reflector for reflecting light emitted by at least one of the light bulbs outwardly from the light fixture, at least one of the light bulbs disposed external of a reflective area of the reflector.

6. The light fixture of claim 1, wherein at least one of the light bulbs is couplable to a door, the door rotatably coupled to the housing.

* * * * *